United States Patent [19]

Stahlecker

[11] Patent Number: 4,958,486

[45] Date of Patent: Sep. 25, 1990

[54] PROCESS AND AN ARRANGEMENT FOR PIECING AN AIR-SPUN YARN

[75] Inventor: Fritz Stahlecker, Bad Überkingen, Fed. Rep. of Germany

[73] Assignee: Hans Stahlecker, Fed. Rep. of Germany; a part interest

[21] Appl. No.: 350,520

[22] Filed: May 11, 1989

[30] Foreign Application Priority Data

May 20, 1988 [DE] Fed. Rep. of Germany ..... 3817222

[51] Int. Cl.[5] ..... D01H 1/15; D01H 15/00

[52] U.S. Cl. ..... 57/261; 57/328; 242/35.6 R; 242/42; 242/47

[58] Field of Search ..... 57/22, 261, 263, 279, 57/280, 328, 333, 352; 242/35.5 R, 42, 47

[56] References Cited

U.S. PATENT DOCUMENTS

| | | | |
|---|---|---|---|
| 4,121,409 | 10/1978 | Uchida et al. | 57/22 |
| 4,456,188 | 6/1984 | Sakai et al. | 57/328 X |
| 4,598,539 | 7/1986 | Stahlecker et al. | 57/263 |
| 4,790;130 | 12/1988 | Stahlecker et al. | 57/328 X |
| 4,833,874 | 5/1989 | Stahlecker et al. | 57/22 X |

FOREIGN PATENT DOCUMENTS

| | | | |
|---|---|---|---|
| 2501735 | 7/1976 | Fed. Rep. of Germany | 57/263 |
| 3611050 | 8/1987 | Fed. Rep. of Germany . | |
| 3634464 | 4/1988 | Fed. Rep. of Germany | 57/328 |
| 2136461 | 9/1984 | United Kingdom . | |
| 2136462 | 9/1984 | United Kingdom . | |

*Primary Examiner*—Joseph J. Hail, III

*Attorney, Agent, or Firm*—Evenson, Wands, Edwards, Lenahan & McKeown

[57] ABSTRACT

In a process and an arrangement for piecing an air-spun yarn, it is provided that the newly spun yarn end is gripped and is fed to a yarn connecting device, in which case it is brought into the range of action of a yarn storage device which is connected in front of the yarn connecting device. This yarn storage device is able to be activated when the yarn connecting device is operated and to store the then supplied yarn in several loops in such a manner that, during and after the yarn connecting, the continuously supplied yarn is still taken in by the yarn storage device until the excess length of yarn existing between the inlet of the yarn storage device and the partially wound spool is used up by driving the partially wound spool at a winding speed which is higher than the operating speed.

17 Claims, 10 Drawing Sheets

PROCESS AND AN ARRANGEMENT FOR PIECING AN AIR-SPUN YARN

BACKGROUND AND SUMMARY OF THE INVENTION

The invention relates to a process and an arrangement for piecing an air-spun yarn wherein the new yarn end which is produced by the resuming of the spinning operation is taken up and fed to a yarn connecting device for producing a yarn connection between this new yarn end and an old yarn end withdrawn from a partially wound spool.

From German Published Examined Patent application No. (DE-A) 36 11 050, it is known to feed two yarns made of slivers, which were only prestrengthened by means of pneumatic false-twist spinning, as a double yarn, to a splicing arrangement and to splice them there with a double yarn wound off a wind-up spool. A yarn storage device is connected in front of the splicer. Both are part of a movable servicing device. For the emptying of the yarn storage device, the partially wound spool is temporarily driven at a higher speed, after the splicing. The storage device itself is constructed as a simple suction pipe which can take in only one loop.

It was also known from British application No. (GB-A) 21 36 462 to construct a yarn storage device in the form of several suction pipes, which can be activated successively and which serve for receiving a yarn quantity which occurs during a splicing operation when the delivery is not reduced. In this yarn storage device, several loops form behind one another, the individual suction pipes being controlled by a slide valve.

It was also known from British Published Patent application No. (GB-A) 21 36 461 to provide a yarn storage device for a broken yarn in the form of a roller, which is subjected to suction, on which the continuously supplied yarn is deposited in the form of loops.

An object of the invention is to provide a process of the initially mentioned type which can be used for the very high yarn delivery speeds which are possible during air spinning, particularly for only prestrengthened double yarns.

This object is achieved in that the new yarn end is gripped and guided to the yarn connecting device, in which case it is brought into the range of action of a yarn storage device, which is arranged in front of the yarn connecting device and can be activated when the yarn connecting device is operated. The yarn storage device stores the supplied yarn in several loops in such a manner that, during or after the yarn connecting, the continuously supplied yarn is still received by the yarn storage device for so long until the excessive yarn length, present between the inlet of the yarn storage device and the partially wound spool, is used up by means of driving the partially wound spool at a winding speed that is higher than the operational speed.

As a result of the fact that the yarn storage device will be activated only when it is required, specifically when the connecting of the yarn, particularly a splicing, is carried out, the yarn quantity which must be stored by it is limited. Only that quantity of yarn must be stored that occurs during the stoppage and the subsequent emptying of the storage device. This means that the storage capacity must be slightly larger than the capacity required for the pure stoppage time during the splicing. If, subsequently, the storage device is emptied at very high winding speeds, such as winding speeds which are twice as high as the operational speed, the excess capacity of the yarn storage device may also be maintained relatively low. In the case of embodiments used in practice, it is sufficient for the storage capacity to be at least 1.15 times and preferably 1.2 times to 1.4 times the yarn length supplied by the respective spinning arrangement during the stoppage time while the yarn connecting device is operated.

Other objects, advantages and novel features of the present invention will become apparent from the following detailed description of the invention when considered in conjunction with the accompanying drawings.

DETAILED DESCRIPTION OF THE DRAWINGS

Figure 1:
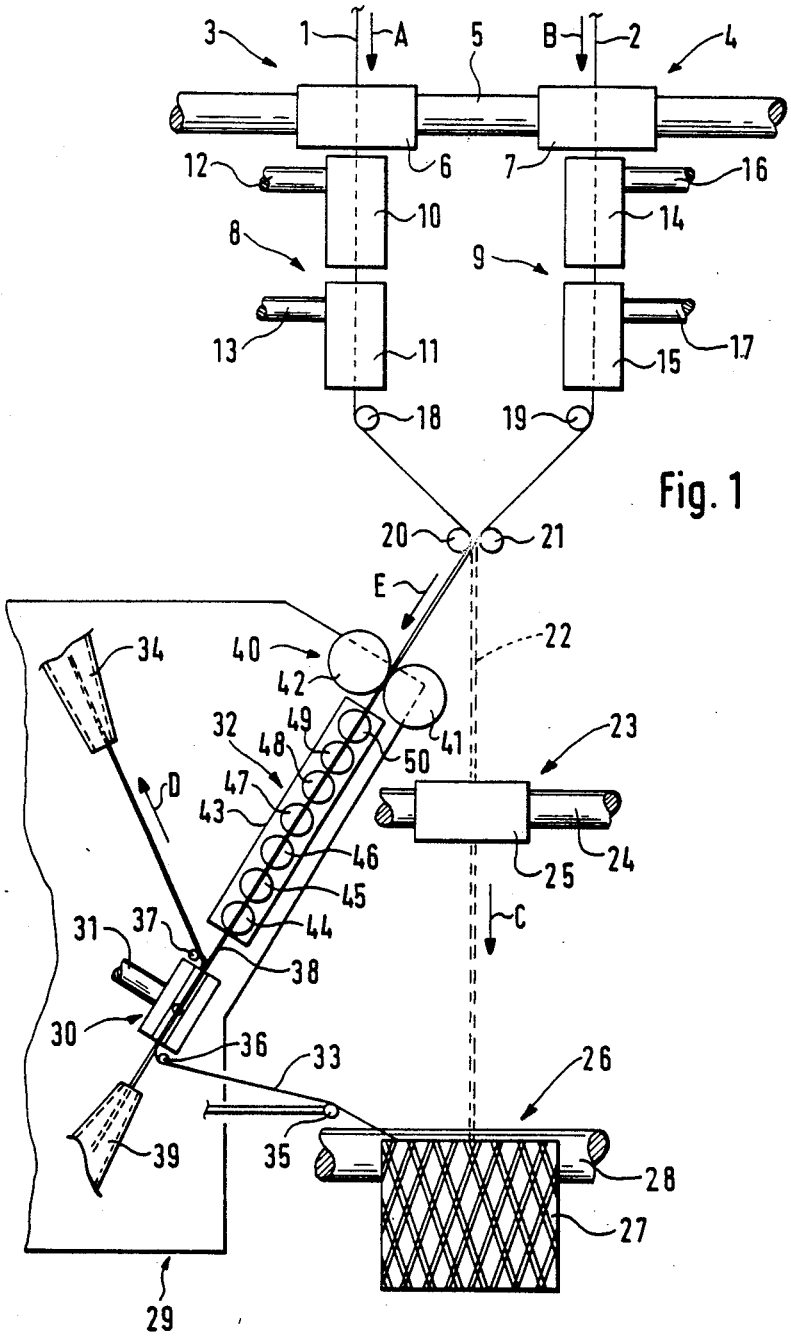
FIG. 1 schematically shows an arrangement for the pneumatic false-twist spinning of two prestrengthened yarns, which are wound onto a spool, which is used as a feeding package for twisting, an automatic servicing device operating at the shown arrangement, which carries out a piecing after a yarn breakage, constructed in accordance with a preferred embodiment of the invention.

In FIG. 1, an arrangement for pneumatic false-twist spinning is represented schematically. This arrangement spins two slivers 1, 2, which were drawn or drafted to the desired size in drafting units 3, 4, which are only outlined, to prestrengthened yarn components. The drafted slivers are withdrawn as a double yarn 22, by a withdrawal device 23 and are fed to a wind-up device 26 in the direction of the arrow (C), by which the double yarn 22 is wound onto a cross-wound Package 27. Customarily, a spinning machine contains a plurality of such spinning units, which are arranged in a row next to one another on one side of the machine.

Of the drafting units 3, 4, through which the slivers 1, 2 pass in the direction of the arrows (A and B), only the pair of delivery rollers is shown in each case, which consists of a common bottom cylinder 5 driven at the machine end and of a respective top roller 6 and 7.

Pneumatic false-twisting elements 8, 9 are connected behind the two drafting units 3, 4. These pneumatic false-twisting elements 8, 9 each contain two air nozzles 10, 11 and 14, 15, which are arranged behind one another and are connected to compressed-air feeding lines 12, 13, 16 17. The air nozzles 10, 14, which, in each case, are first in the yarn travel direction, are constructed as intake nozzles which provide the yarn components 1, 2 with no or almost no twist. Only the air nozzles 11, 15, which follow, provide the yarn components 1, 2 with a false twist, which has opened up again after leaving the air nozzles 11, 15. The ends of some fibers remain wound around the then essentially no longer twisted sliver so that two prestrengthened yarn components 1, 2 are present, the strength of which is not yet sufficient for a further processing as a yarn.

Yarn guides 18, 20 and 19, 21 are connected behind the pneumatic false twist elements 8, 9, and guide together the prestrengthened yarn components 1, 2 to a double yarn 22 which, corresponding to the dotted double line, is withdrawn by the withdrawal device 23 formed by a continuous, driven bottom cylinder 24 and a pressure roller 25. The spool package 27 is driven by a winding roller 28, which passes through and is driven at the machine end. Naturally, other elements are also present, by means of which the double yarn 22 is guided such that a cross-wound package can be wound, such as a cross-winding yarn guide and tension compensating devices or the like. The arrangement operates at high delivery speeds, which may be above 300 m/min.; i.e., the double yarn 22 is withdrawn by the withdrawal device 23 at 300 m/min. or more, and is wound up by the wind-up device 26 onto the package 27 at a corresponding speed.

In the case of a yarn breakage, i.e., when one or both yarn components 1, 2 break, the continued production of the yarn components 1, 2 is stopped. Subsequently, the double yarn 22 must be connected, for a piecing with the yarn components 1, 2 produced by the restarting of the spinning operation. This piecing is carried out by a movable servicing device 29, which can be selectively applied to the individual spinning units and is shown in FIG. 1 only very schematically and in a simplified manner. It should be pointed out that the elements of the servicing device 29 are shown in an arrangement that is offset by 90°; i.e., deviating from the representation, they are arranged such in practice that they operate in front of the spinning unit.

During the piecing operation, the partially wound spool package 27 is separated from its wind-up device 26 so that it can be driven in wind-off direction as well as in wind-up direction by the devices of the servicing device 29, for example, by means of a winding roller 51 (FIG. 2) which can be applied to the lifted-off partially wound spool package 27 and can be driven in both rotating directions. The double yarn is gripped by a suction device 34 and is withdrawn in the direction of the arrow (D), taking up position 33. In this case, the double yarn 33 is guided around two guiding elements 36, 37 and is placed into a splicing arrangement 30, which is connected to a compressed-air source by means of a compressed-air supply line 31, which can be controlled via a valve. In a known manner, the pneumatic yarn splicing device 30 contains yarn guiding elements, yarn clamps, and cutting devices which are operated during the splicing operation.

For the piecing, the production of the two prestrengthened yarn components 1, 2 is resumed, which had been previously interrupted in a controlled manner by the yarn guards. The prestrengthened yarn components 1, 2 are taken in by a suction device 39 of the servicing device 29, which can be applied to the yarn guides 18, 19. The yarn components 1, 2 are guided by means of the yarn guides 20, 21 and are placed in a delivery device 40, which includes two delivery rollers 41, 42, of the servicing device 29 and are then applied to the splicing device 30 such that the newly pieced yarn components, which form a double yarn 38, extend in the opposite direction of the double yarn 33 connected with the partially wound spool 27. The delivery device 40 withdraws the double yarn 38 at a speed which corresponds to the operating speed of the withdrawal device 23, so that the double yarn 38 is present in a condition which corresponds to the condition of the double yarn 22 at normal operating conditions. The double yarn 38, which is sucked off by the suction device 39, will come to a standstill in the area of the splicing arrangement 30 only when this splicing arrangement 30 starts to operate; i.e., when yarn guides, which position the double yarn 38 in the splicing chamber 30, and yarn clamps or the like become operative. At this moment, a yarn storage device 32 is activated, which is arranged between the splicing arrangement 30 and the delivery device 40 of the servicing device 29.

The yarn storage device 32 includes a given number of suction pipes 44 to 50, which are arranged in a row behind one another, and the mouths of which are directed at the double Yarn 38. The suction pipes 44 to 50 can be activated in a timed manner, being, in a timed manner, acted upon by an increased suction pull and subsequently by a lower suction pull. The storing of yarn starts at suction pipe 44; i.e., at the suction pipe 44 which is directly adjacent to the splicing arrangement 30. Subsequently, the increased suction pull is switched to the next suction pipe 45, which follows against the yarn travel direction E, which will then be filled with a loop, before, in a corresponding manner, the switching takes place to the next suction pipe 46. The respective preceding suction pipe (44, 45, etc.), during the respective switching, is switched to a lower suction air current, so that the taken-in yarn loops are held in a drawn manner. The number of suction pipes 44 to 50 depends on the delivery speed of the double yarn, on the time required by the splicing arrangement 30, and on the winding speed, at which the partially wound spool package 27 can be driven after the splicing. If, for example, the delivery speed is 300 m/min., 5 m/sec. of double yarn 38 are delivered. If the splicing time amounts to 1 sec. (it will normally be clearly below that), 5 m double yarn must be stored during this time. If each of the suction pipes 44 to 50 takes in 1 m double yarn, five pipes are required for this purpose. When the winding-up is resumed, correspondingly, an additional 5 m of double yarn 38 must be wound up (for reasons of simplicity, the excursion with respect to the normal movement of the yarn is not taken into account). When the winding-up of the spliced double yarn 38 onto the partially wound spool package 27 takes place at a wind-up speed which is twice as high as the delivery speed, i.e., at 10 m/sec., the 5 m of double yarn are wound up within 0.5 sec. This means 2.5 m double yarn are still being supplied, before the originally stored quantity of the yarn storage device 32 is evacuated. However, the supply continues to take place even during the evacuation of the 2.5 m of double yarn. The yarn storage device 32 must therefore be capable of storing more than 7.5 m of double yarn. In view of the fact that it takes a certain time before the partially wound spool package 27 is brought to the high withdrawal speed, and that the partially wound spool package 27, shortly before the end of the using-up of the stored yarn quantity, must be braked again to the operating speed, eight suction pipes 44 to 50 should be provided in the calculated example. However, as shown in the following, this number may be reduced by means of an advantageous arrangement.

It should also be pointed out that the yarn ends, which extend between the suction devices 34, 39 and the splicing arrangement 30, are cut off the spliced double yarn and sucked off by means of these suction devices 34, 39. In addition, a yarn guide 35 is provided at the servicing device 29, which supplies the spliced double yarn, in a controlled manner, to the cross-winding devices and compensating devices or the like, which are not shown. After the spliced double yarn has resumed the normal yarn movement, the partially wound spool package 27 is supplied to the winding roller 28, so that the piecing operation is completed.

In the embodiments explained in the following, the reference numbers are used again which were used in connection with FIG. 1, when the same components are involved or components which at least have the same function, which will then not be described again.

Figure 2:
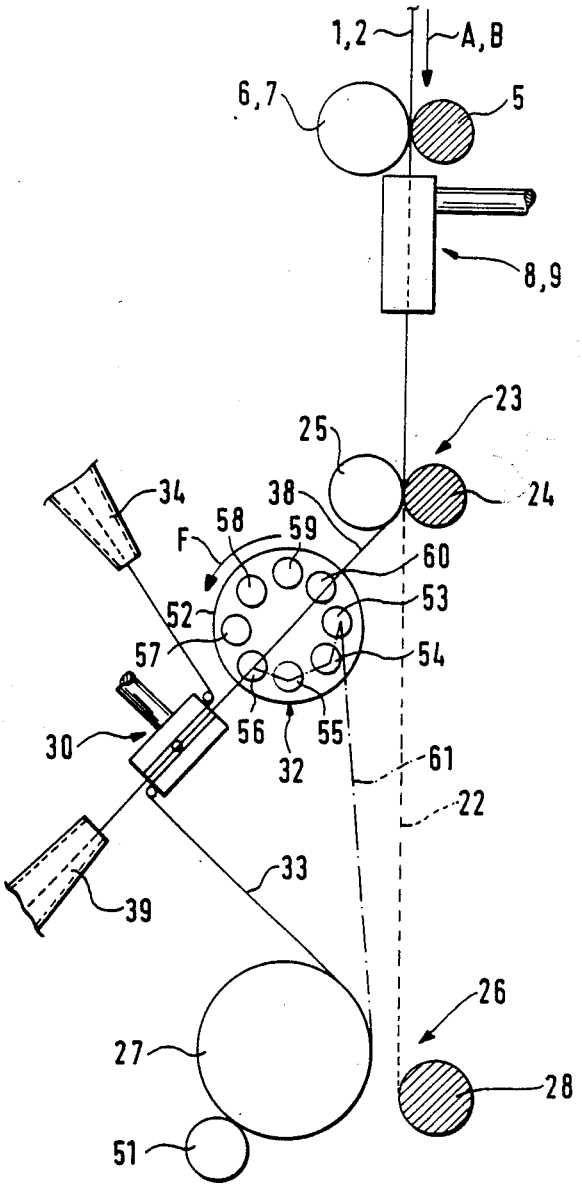
FIG. 2 is a lateral schematic view of an embodiment, similar to FIG. 1, with a servicing device, which is modified particularly in the area of the yarn storage device.

FIG. 2 is a view of a spinning unit in longitudinal direction of the machine; i.e., in longitudinal direction of the driven bottom cylinders 5, 24 and of the winding roller 28. In this embodiment, it is provided that the servicing device 29 is not equipped with its own delivery device. In contrast, it uses the withdrawal device 23 of the spinning unit for the piecing. Between this withdrawal device 23 and the splicing arrangement 30, a yarn storage device 32 is arranged, which comprises a plurality of suction pipes 53 to 60, which, with their mouth, are arranged on a circle, i.e., in a rotatable holding device 52 which can be rotated, in a timed manner, in the direction of the arrow (F). Also in this embodiment, the suction pipe which in each case is adjacent to the splicing arrangement 30, is filled with a loop and, for this purpose, is connected to an increased suction pull, while the other suction pipes are acted upon with only a low suction pull. By means of the dash-dotted lines, it is shown that the splicing operation has ended and the double yarn 61 is wound onto the partially wound spool 27 package at an increased speed. In this case, the double yarn 61 is pulled in a straight manner out of the suction pipe 53, while, as a result of the continued supplying of the double yarn 38 by the withdrawal device 23, the suction pipe 56 is filled. The yarn storage device 32, which is shown in FIG. 2 and which may be called a turret storage device, has the advantage that the suction pipes, which have been emptied, are applied again to the filling point in the area of the splicing arrangement 30, so that, during one piecing process, they may be used at least twice. As a result, the number of suction pipes 53 to 60 can be reduced.

Figure 3:
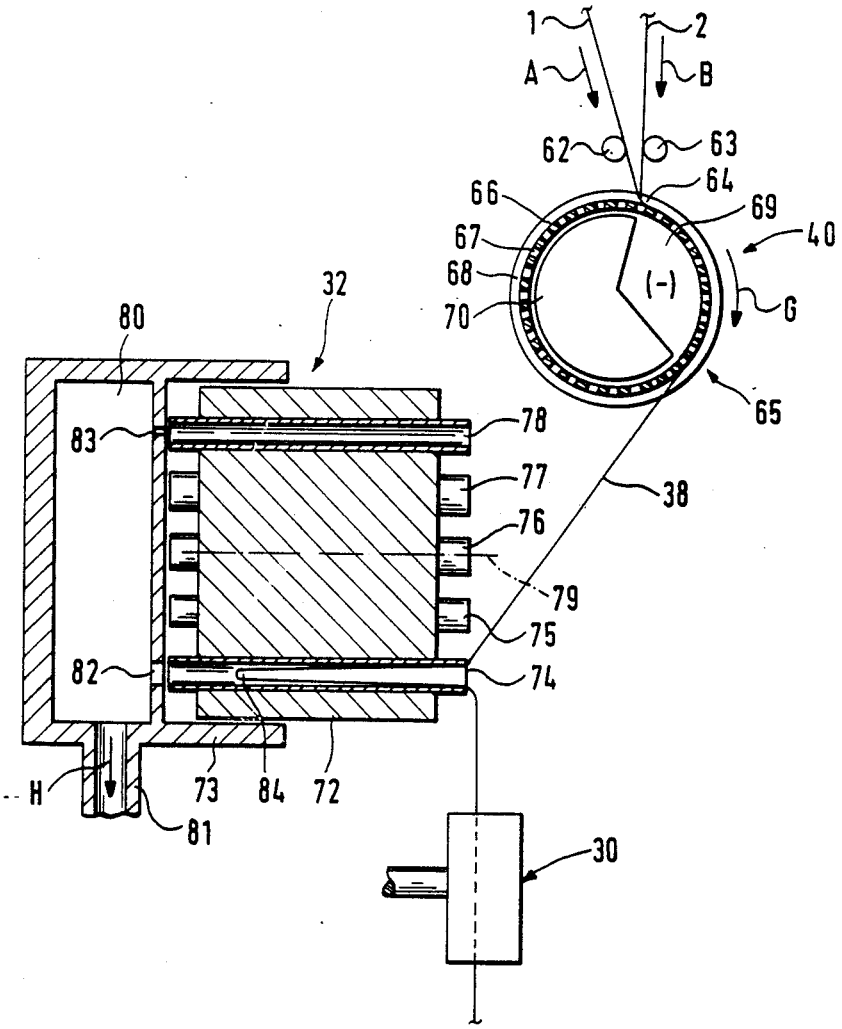
FIG. 3 is an enlarged schematic view of another embodiment, similar to FIG. 2, with a modified delivery device of the servicing device.

In FIG. 3, a turret storage device is shown as the yarn storage device 32, which is similar to the embodiment according to FIG. 2. This yarn storage device 32 contains suction pipes 74 to 78, which are arranged on a circle in a holding device 72, which is pivotable or rotatable around a shaft 79 in a manner which is not shown in detail, and can be driven in a timed manner. The mouths of the suction pipes 74 to 78 face the double yarn 38, while the other ends face a wall of a housing 73. The housing 73, which is arranged stationarily, forms a chamber 80 which is acted upon by a suction air current via a suction connection 81, which is sucked off in the direction of the arrow (H). In the wall air current which is assigned to the ends of the suction pipes 74 to 78, openings 82 and 83 are provided which are located opposite the ends of the suction pipes 74 to 78. The opening 82, which faces the suction pipe 74 adjacent to the splicing device 30, is significantly larger than the other openings 83 so that a relatively strong suction pull is generated here. The other suction openings 83, which are also arranged on a circle, are correspondingly smaller so that a relatively weak suction pull is generated, which, however, is sufficient for holding the yarn loops 84 straight which are sucked into the suction pipes 74 to 78.

In the embodiment according to FIG. 3, the servicing device 29 has a delivery device 40 in the form of a roller 65 having a V-shaped groove 68, the groove base of which is provided with a perforation 67 and which, in a manner which is not shown in detail, is connected to a suction device, the suction effect of which is limited to a sector 69 by means of an insert 70. Two yarn guides 62, 63 are connected in front of the suction roller 65, the two yarn components 1, 2 being supplied to the start 64 of the sector 69, which is subjected to suction, by means of these two yarn guides 62, 63.

Figure 4:
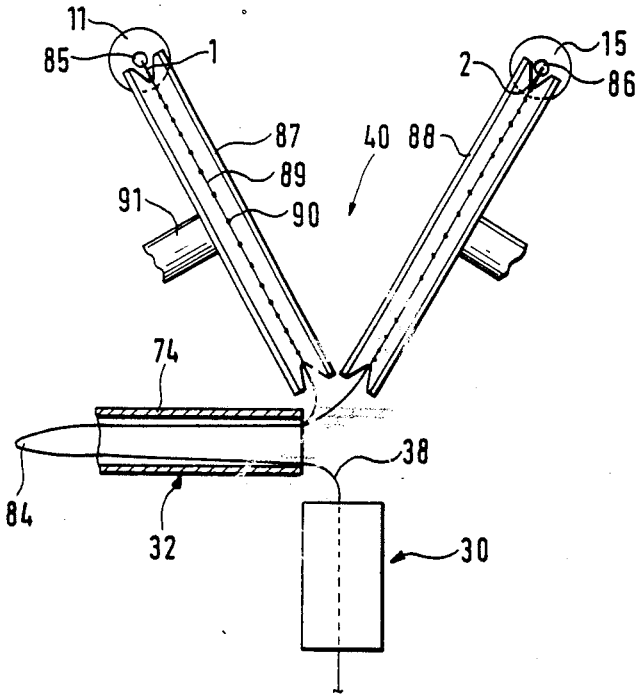
FIG. 4 is an enlarged schematic view of another embodiment, similar to FIG. 3, but with a modified delivery device.

In the embodiment according to FIG. 4, only a part of a suction pipe 74 is shown as part of a yarn storage device 32, specifically a part of that suction pipe which is directly adjacent to the splicing arrangement 30. In this embodiment, the servicing device 29 is equipped with two rollers 87, 88 forming a delivery device 40, these rollers 87, 88 having V-shaped grooves 89 and a perforation at the groove base. These rollers 87, 88 take over the yarn components 1, 2 at the respectively second air nozzles 14, 15, the outlet ducts 85, 86 of which are shown in FIG. 4. The two rollers 87, 88 are arranged in a V-shape, so that the two yarn components 1, 2 are guided together and, when leaving the rollers 87, 88, form a double yarn 38.

Figure 5:
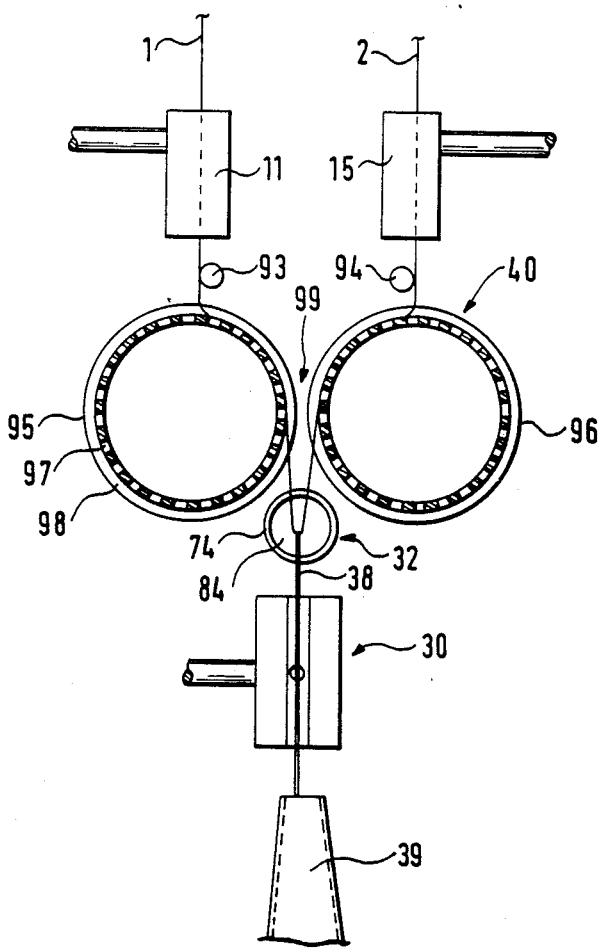
FIG. 5 is an enlarged schematic view of another embodiment with an also modified delivery device.

In the embodiment according to FIG. 5, the servicing device 29 is equipped with a delivery device 40, which, similar to the embodiment of FIG. 4, consists of two rollers 95, 96, which are subjected to suction. These rollers 95, 96 each have a V-shaped groove 98, the bottom of which is provided with a perforation 97 and which, on the inside, are acted upon by suction pressure. The two rollers 95, 96, are arranged next to one another with parallel axes, in such a manner that they form a type of wedge-shaped gap. The two rollers 95, 96 rotate in opposite directions so that they take over the yarn components 1, 2 leaving the air nozzles 11, 15, which are guided by the yarn guides 93, 94 and guide them together to form a double yarn 38 in the area of a gap 99. Also in the embodiment according to FIG. 5, only one suction pipe 74 of a yarn storage device 32 is shown. This is preferably also a turret storage device.

Figure 6:
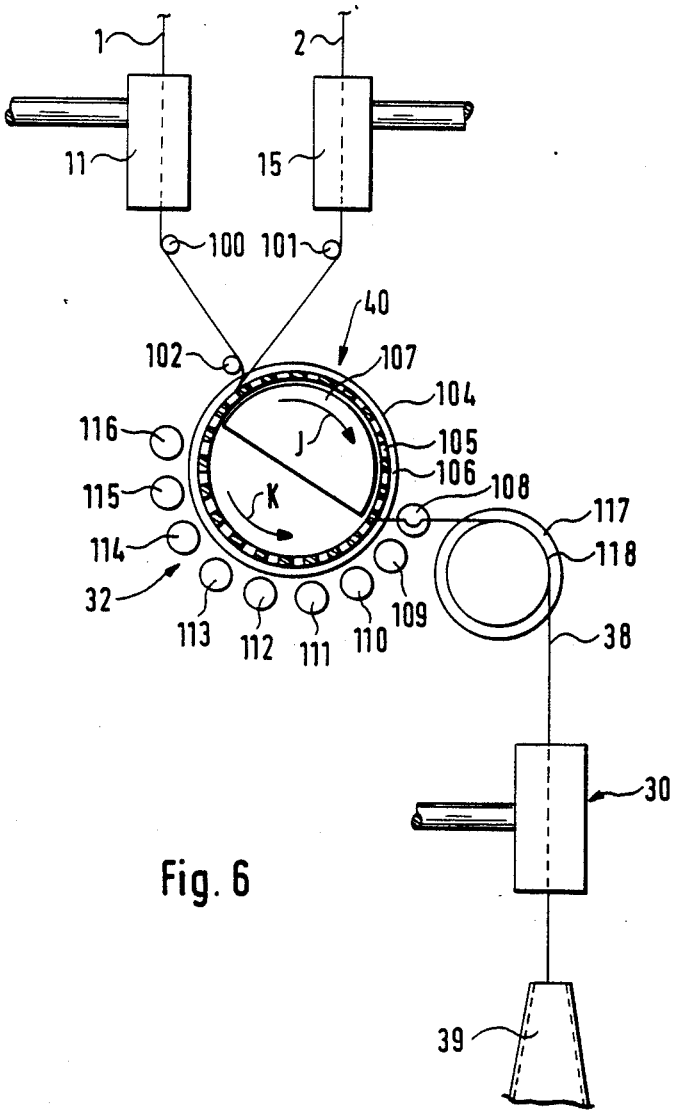
FIG. 6 is an enlarged schematic view of another embodiment with a modified delivery device, and with a yarn storage device, adapted to this delivery device.

In the embodiment according to FIG. 6, a servicing device 29 is equipped with a delivery device 40, which is constructed as a roller 104 subjected to suction, this delivery device 40 being arranged behind yarn guides 100, 101 arranged in each case behind the second air nozzles 11, 15 and a yarn guide 102, which combines the two yarn components 1, 2 to a double yarn 38. The roller 104 has a guiding groove 106, the base of which is provided with a perforation 105 and to the interior of which a suction device is assigned. In the interior of the roller 104, an insert 107 is located which determines the area subjected to suction. The roller 104 is driven in the direction of arrow (K) at delivery speed. It is followed by another guide roller 117, which is also driven and has a V-shaped groove 118. The double yarn 38 moves tangentially off this guide roller 117 and moves to the splicing arrangement 30.

In the embodiment according to FIG. 6, several suction pipes 108 to 116 are provided as the yarn storage device and are arranged on the arc of a circle around the roller 104 serving as the delivery device 40.

During the splicing operation; i.e., when a storing of yarn is required, the guiding roller 117 is stopped. The insert 107, is switched in a timed manner, to move in the direction of the arrow (I) against the moving direction of the roller 104 such that its limiting edge successively reaches the area of the suction pipes 108 to 116 in each case. At the same time, the suction pipes 108 to 116 are acted upon correspondingly by a strong suction pull and a weak suction pull. Thus, the suction pipes 108 to 116 are successively filled with the double yarn, which in each case is stored in the shape of a yarn loop. When the wind-up process is resumed; i.e., after the completion of the splicing, the last suction pipes, such as suction pipes 114 to 116, are still vacant and will then be filled, while the double yarn is already being withdrawn from suction pipes 108 to 113. In the embodiment according to FIG. 6, the suction pipes 108 to 116 are shown to be arranged so that their axes are parallel to the axis of roller 104. It is also contemplated to align these suction pipes 108 to 116 such that they are directed radially or approximately radially to the circumference of roller 104.

Figure 7:
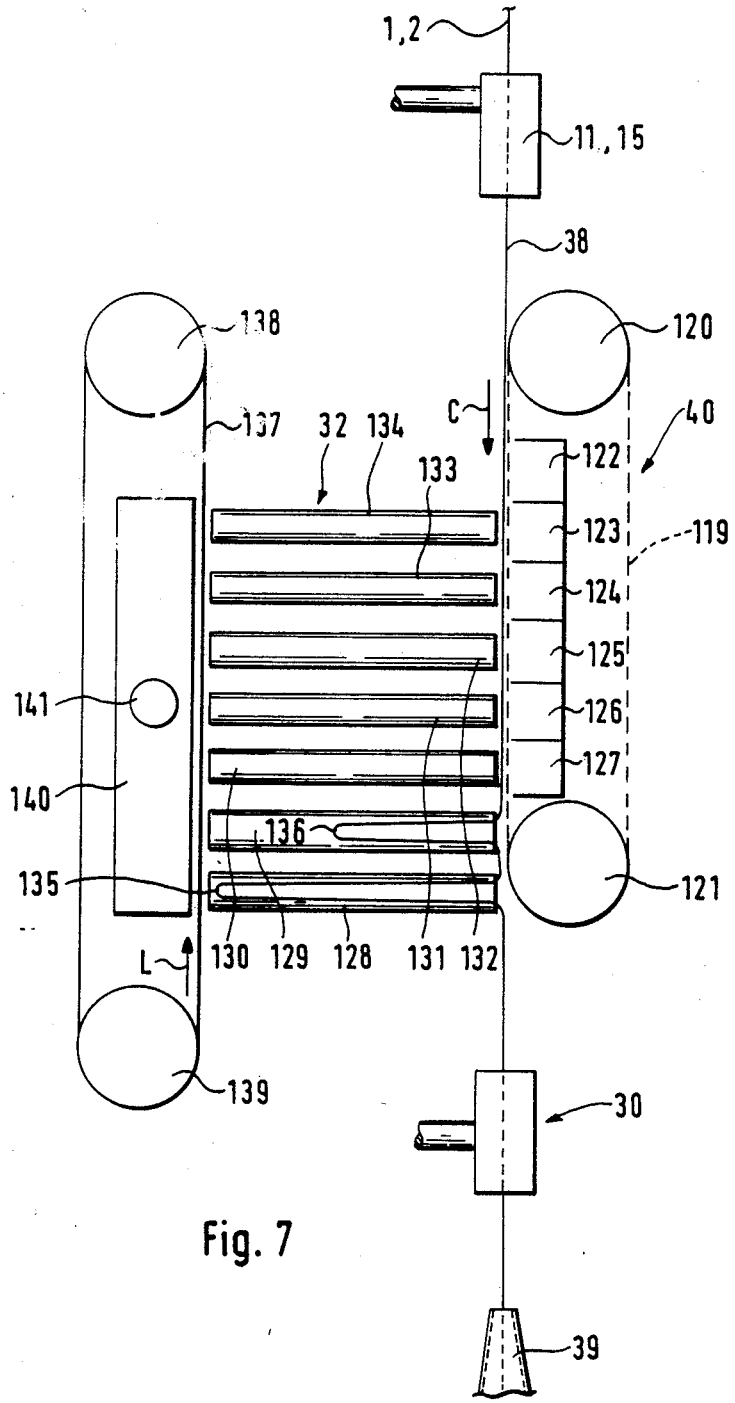
FIG. 7 is an enlarged schematic view of another embodiment with combined delivery device and yarn storage device.

In the embodiment according to FIG. 7, the servicing device 29 is equipped with a delivery device 40 in the form of a belt 119, which can be applied to the air nozzles 11, 15 and which is arranged in front of the splicing arrangement 30. The belt 119 is wound around two deflecting rollers 120, 121; of which one is driven. The belt 119 is constructed as a screen belt, which is equipped on the inside with a suction device, which, for a uniform pressure distribution, is divided into individual chambers 122 to 127.

On the yarn-guiding side, a yarn storage device 32 is located opposite the screen belt 119, this yarn storage device 32 comprising several suction pipes 128 to 134 arranged in a row behind one another, a common suction device 140 being assigned to the ends of these suction pipes 128 to 134, which is provided with a suction connection 141. Between the suction device 140 and the suction pipes 128 to 134, a control belt 137 is guided, which belt 137 is provided with openings controlling the admission to the suction pipes 128 to 134. The control belt 137 is guided around deflecting rollers 138, 139, of which at least one is driven.

The control belt 137 of the embodiment according to FIG. 7 moves in the direction of the arrow (L), being driven in a timed manner. At the start of the splicing and thus at the time of the interruption of the continued sucking-off of the double yarn 38 by means of the suction device 39, the control belt 137 connects the suction pipe 128 with a relatively large opening, which is located closest to the splicing arrangement 30, with the suction device 140, so that a yarn loop 135 is sucked into this suction pipe 128. After a given time period, the control belt 137 switches the large opening on to the next suction pipe 129, while, at the same time, a small opening is assigned to suction pipe 128. Now a yarn loop 136 is sucked into suction pipe 129. This will be continued until the splicing operation is completed and also still while the double yarn 38 after the splicing is again withdrawn from the first suction pipes 128, 129.

It is also contemplated, as a modification of the embodiment according to FIG. 7, to assign, instead of a control belt, valves or a control slide or the like to the suction pipes 128 to 134.

Figure 8:
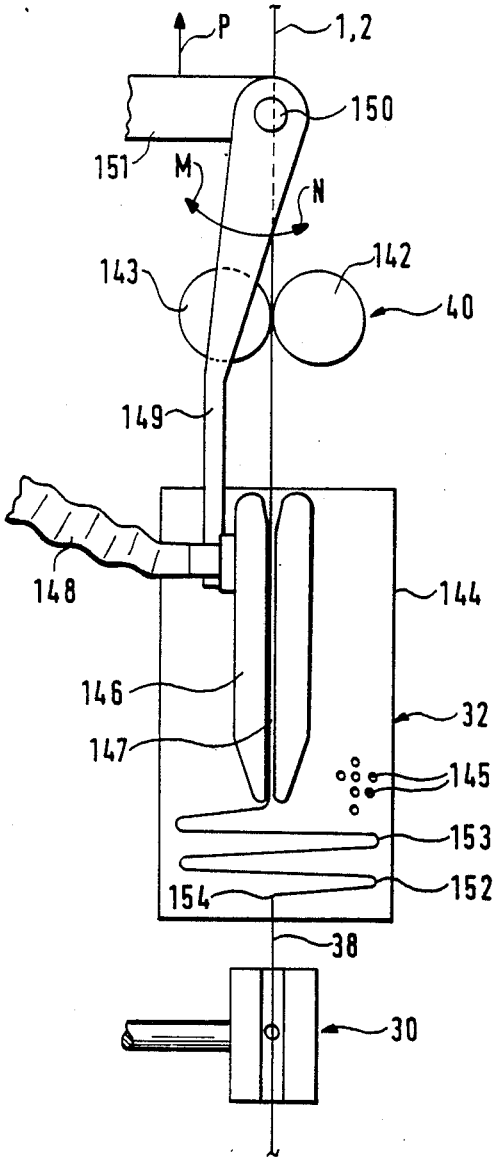
FIG. 8 is an enlarged schematic view of another embodiment with a yarn storage device containing a laying device for the laying of loops.

In the embodiment according to FIG. 8, a servicing device contains a pair of delivery rollers 142, 143 as the delivery device 40. Between the pair of delivery rollers 142, 143 and the splicing arrangement 30, a yarn storage device 32 is arranged, which has a depositing surface in the form of an apertured plate 144, which is provided with perforations 145 and, on its rear side, is connected to a suction device. An injector nozzle 146 is connected behind the delivery device 40, the double yarn 38 being guided into this injector nozzle 146 via a longitudinal slot 147, via which it may also be guided out again. The injector nozzle 146 is connected to a comPressed-air supply line 148. It is held by a swivel arm 149, which is driven to perform a back-and-forth swivelling motion in the direction of the arrows (M and N) around an axis extending perpendicularly with respect to the depositing surface 144. The swivel shaft 150 and the swivel lever 149 are arranged on a holding device 151, which can be adjusted against the moving direction of the yarn in the direction of the arrow (P).

Before the splicing operation, the injector nozzle 146, with its discharge mouth, is located in the area of the edge of the apertured plate 144 which faces the splicing arrangement 30. No later than at the start of the phase of the splicing operation during which the double yarn 38 is clamped fast, the injector nozzle 146 starts its back-and-forth motion in the direction of the arrows (M and N) and simultaneously its motion in the direction of the arrow (P) against the yarn feeding direction, so that the continuously supplied double yarn 38 is deposited on the apertured plate 144 in the form of yarn loops 152, 153.

Also in the embodiment according to FIG. 8, it is provided that the storage capacity of the yarn storage device 32 is larger than it is required for the length of the double yarn 38 which is required during the pure stoppage time of the yarn inside the splicing arrangement 30.

As a modification of the embodiment according to FIG. 8, it is provided that, instead of an apertured plate 144, a plate is provided with an adhesive covering, such as a plush covering. In this case, the arrangement is such that the depositing surface is located at least approximately perpendicularly below the injector nozzle 146. It will then also be possible to provide a pair of delivery rollers instead of an injector nozzle 146.

As a further modification of the embodiment according to FIG. 8, it is provided that, instead of the apertured plate 144, a receptacle is arranged essentially perpendicularly below the injector nozzle 146 (or under a pair of delivery rollers), into which the double yarn 38 is dropped by means of only a cross-winding movement in the direction of the arrows (M and N), without any movement in the direction of the arrow (P) being superior to the cross-winding movement.

Figure 9:
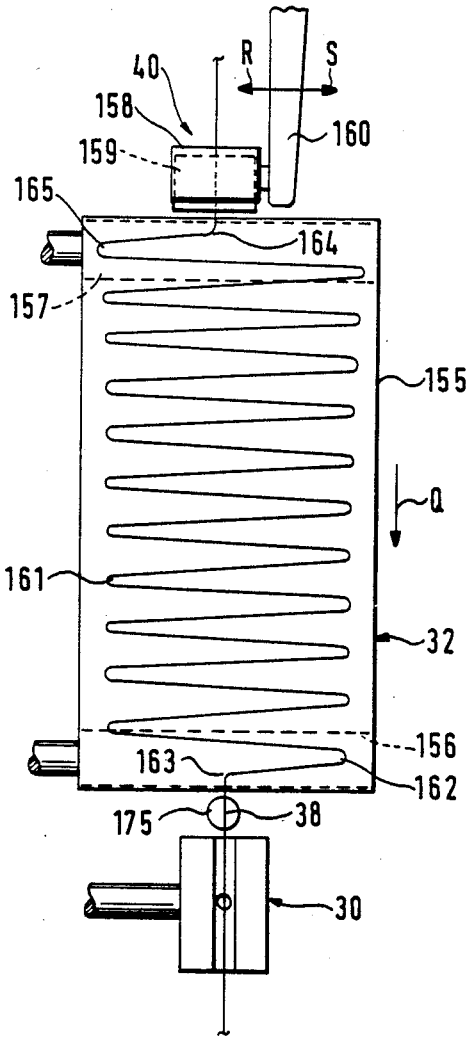
FIG. 9 is an enlarged schematic view of another embodiment having a laying device.

In the embodiment according to FIG. 9, between a delivery device constructed as a pair of delivery rollers 158, 159 and the splicing arrangement 30, a belt 155 is arranged as a yarn storage device 32, which moves at a relatively slow speed in moving direction of the yarn and which is guided around two deflecting rollers 156, 157, of which one is driven. The belt 155 is constructed as a screen belt and, on its rear side, is equipped with a suction device. In another embodiment, the screen belt, which moves in the direction of the arrow (Q) with respect to the splicing arrangement 30, is constructed as a plush belt; i.e., as a belt which can exercise a holding force on yarns, which are placed on it. Between the belt 155 and the splicing arrangement 30, a suction pipe 175 is arranged, which is constructed such that it can take in that length of yarn, which corresponds to the distance between the delivery device 40 and the splicing arrangement 30.

In the embodiment according to FIG. 9, the double yarn 38 moves first in a straight line from the delivery device 40 through the splicing arrangement 30 and to the suction device, which is not shown. The belt 155 may stand still during this time period. When the yarn movement in the area of the splicing arrangement 30 comes to a standstill, the double yarn 38 will then be deposited in loops 161, 162, 164, 165 on the belt 155, which will then be moving. For this purpose, it is provided that the delivery device 40 carries out a back-and-forth movement in the direction of the arrows (R and S). The delivery device 40 is arranged on a lever 160, which is driven to perform movements in this direction.

Figure 10:
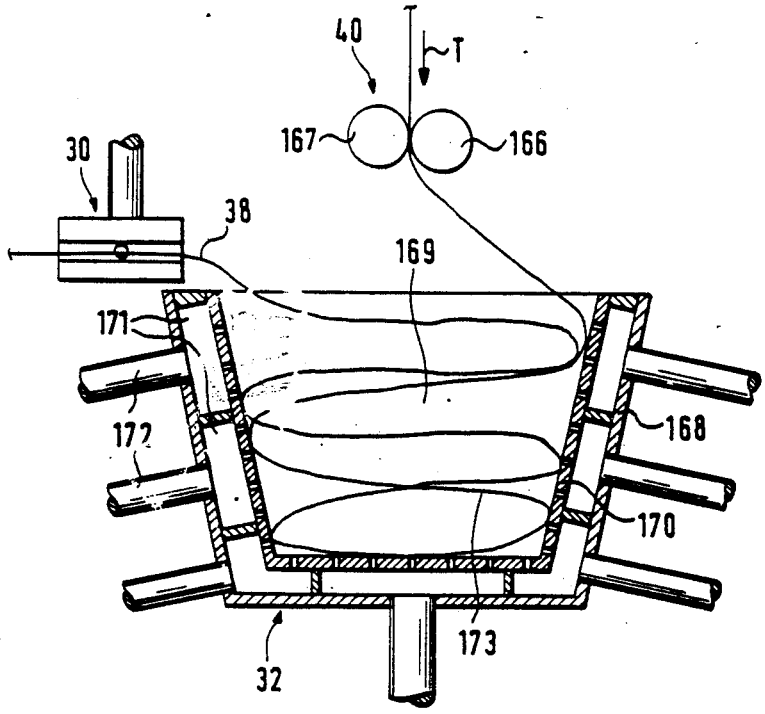
FIG. 10 is an enlarged schematic view of an embodiment with a simplified construction of a yarn storage device which is constructed as a receptacle which is open toward the top.

In the embodiment according to FIG. 10, a receptacle-type yarn storage device 32 is arranged between a delivery device consisting of two delivery rollers 166, 167 and the splicing arrangement 30, in which the double yarn is deposited "semiindiscriminately"; not absolutely ordered and partially superimposed. For this purpose, it may be provided that the delivery device 40 carries out loop-shaped or circular movements. In addition, it may be provided that the receptacle-shaped yarn storage device consists of an outer pot 168 and an inner pot 170, which are divided into individual chambers 171, to which the suction connections 172 are connected. The inner receptacle 170 is provided with a perforation, so that a storage chamber 169 is created, in which air currents are generated, which are directed toward the outside and downwards. The suction lines 172 are controlled by means of valves, which are not shown.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Arrangement for piecing air-spun yarn supplied by a spinning unit with a previously spun yarn end withdrawn from a partially wound spool package, comprising:

yarn piecing means for piecing yarn ends together, new yarn feeding means for feeding a newly spun yarn end to the yarn piecing means, old yarn feeding means for feeding a previously spun yarn end from a partially wound spool package to the yarn piecing means, yarn storage means for storing the newly spun yarn supplied continuously by a spinning unit during the piecing operation, said yarn storage means including means for forming a plurality of yarn loops therein, and spool package drive control means for driving the spool package at higher than normal spinning operating speeds for a short interval after the piecing operation so as to wind up the excessive length of the yarn stored in the yarn storage means, wherein the yarn storage means contains several suction pipes which can be activated successively, wherein the suction pipes are mounted in a rotatable holding device which is rotationally driven by a turning drive which operates in a timed manner, and wherein control means are provided for activating the suction pipes and for controlling the turning drive.

2. Arrangement for piecing air-spun yarn according to claim 1, wherein mouths of the suctions pipes are arranged in a circular pattern.

3. Arrangement for piecing air-spun yarn according to claim 1, wherein said yarn storage means includes yarn storage control means for controlling the length of yarn stored as a predetermined function of the time duration of the piecing operation and the operation of the drive for the spool package at greater speeds to use up the stored yarn after a piecing operation.

4. Arrangement for piecing air-spun yarn according to claim 3, wherein the air-spun yarn comprises two separate slivers prestrengthened by air spinning to form a double yarn which is pieced with a corresponding double yarn end from the partially wound spool package.

5. Arrangement for piecing air-spun yarn according to claim 1, wherein the air-spun yarn comprises two separate slivers prestrengthened by air spinning to form a double yarn which is pieced with a corresponding double yarn end from the partially wound spool package.

6. Arrangement for piecing air-spun yarn according to claim 1, wherein the yarn storage means has a yarn storage capacity which is greater than the yarn length which is spun by the spinning unit during the stoppage time when the yarn piecing means is operated.

7. Arrangement for piecing air-spun yarn according to claim 1, wherein a movable servicing device is provided which carries out the piecing and includes:

devices for the taking-in of the newly spun yarn end, the yarn piecing means, the yarn storage means, devices for winding-off the old yarn and entering this yarn into the yarn piecing means, and devices for driving the partially wound spool.

8. Arrangement for piecing air-spun yarn according to claim 7, wherein the servicing device is equipped with a yarn delivery device which is connected in front of the yarn storage device and forms part of the new yarn feeding means.

9. Arrangement for piecing air-spun yarn according to claim 8, wherein the delivery device is used for the taking-in and preferably for the guiding-together of a double yarn.

10. A process for piecing air-spun yarn comprising:

feeding a newly spun yarn end to yarn piecing means, feeding a previously spun yarn end from a partially wound spool package to the yarn piecing means, piecing the newly spun yarn end with the old spun yarn end in the yarn piecing means, and withdrawing the pieced yarn by winding the same onto the spool package, wherein the newly spun yarn end is fed continuously from a spinning unit during piecing in the piecing means, wherein the continuously supplied newly spun yarn is stored in a plurality of yarn loops in a yarn storage means during and after the piecing until the excessive length of yarn existing between an inlet of the yarn storage means and the partially wound spool package is used up by driving the partially wound spool package at a winding speed which is greater than the normal yarn spinning operating speed, wherein the yarn storage means contains several suction pipes which can be activated successively, wherein the suction pipes are mounted in a rotatable holding device which is rotationally driven by a turning drive which operates in a timed manner, and wherein control means are provided for activating the suction pipes and for controlling the turning drive.

11. A process for piecing air-spun yarn according to claim 10, wherein the air-spun yarn comprises two separate slivers prestrengthened by air spinning to form a double yarn which is pieced with a corresponding double yarn end from the partially wound spool package.

12. A process for piecing air-spun yarn according to claim 11, wherein the yarn storage means has a yarn storage capacity of between 1.1 and 1.4 times the length of newly spun yarn supplied during the interval of time required for the piecing operation.

13. A process for piecing air-spun yarn according to claim 10, wherein said yarn storage means includes suction means and suction control means for timing and controlling the suction in a predetermined timed relationship with the piecing operation and the operation of the drive for the spool package at greater speeds to use the stored yarn after the piecing operation.

14. A process from piecing air-spun yarn according to claim 10, wherein said yarn storage means includes yarn storage control means for controlling the length of yarn stored as a predetermined function of the time duration of the piecing operation and the operation of the drive for the spool package at greater speeds to use up the stored yarn after a piecing operation.

15. A process for piecing air-spun yarn according to claim 10, wherein the yarn storage means has a yarn storage capacity of between 1.1 and 1.4 times the length of newly spun yarn supplied during the interval of time required for the piecing operation.

16. A process for piecing air-spun yarn according to claim 10, wherein the yarn storage device is disposed on a mobile servicing unit which is selectively movable to a respective spinning unit to perform piecing operations.

17. A process for piecing air-spun yarn according to claim 10, wherein mouths of the suctions pipes are arranged in a circular pattern.

* * * * *